US008038586B2

(12) United States Patent
Blissett

(10) Patent No.: US 8,038,586 B2
(45) Date of Patent: Oct. 18, 2011

(54) PORTABLE EXERCISE APPARATUS

(76) Inventor: Albert Augustus Blissett, Hertfordshire (GB)

( * ) Notice: Subject to any disclaimer, the term of this patent is extended or adjusted under 35 U.S.C. 154(b) by 0 days.

(21) Appl. No.: 12/457,667

(22) Filed: Sep. 8, 2009

(65) Prior Publication Data

US 2011/0059828 A1 Mar. 10, 2011

(51) Int. Cl.
*A63B 21/02* (2006.01)

(52) U.S. Cl. ..... 482/124; 482/122

(58) Field of Classification Search ..... 482/121, 482/124, 126, 122; 24/614, 615, 625, DIG. 52, 24/68 E, 654
See application file for complete search history.

(56) References Cited

U.S. PATENT DOCUMENTS

| | | | | |
|---|---|---|---|---|
| 650,656 | A | 5/1900 | Raabe | |
| 1,402,179 | A | 1/1922 | Piscitelli | |
| 3,162,441 | A * | 12/1964 | Karlik | 482/124 |
| 4,099,342 | A * | 7/1978 | Singh | 36/44 |
| 4,961,573 | A * | 10/1990 | Wehrell | 482/74 |
| 5,588,940 | A * | 12/1996 | Price et al. | 482/105 |
| 5,613,926 | A * | 3/1997 | Michaelson | 482/121 |
| 5,618,249 | A * | 4/1997 | Marshall | 482/127 |
| 5,647,827 | A * | 7/1997 | Gutkowski et al. | 482/124 |
| 5,678,282 | A * | 10/1997 | Stewart | 24/68 J |
| 5,916,070 | A * | 6/1999 | Donohue | 482/74 |
| 6,125,792 | A * | 10/2000 | Gee | 119/770 |
| 6,368,262 | B1 * | 4/2002 | Willoughby et al. | 482/148 |
| 6,851,160 | B2 * | 2/2005 | Carver | 24/197 |
| 6,959,810 | B2 * | 11/2005 | Neilson | 206/314 |
| 7,375,517 | B1 * | 5/2008 | Cinoglu et al. | 324/300 |
| 7,563,212 | B2 * | 7/2009 | Smith | 482/124 |
| 7,608,026 | B1 * | 10/2009 | Nicassio | 482/124 |
| 7,628,742 | B2 * | 12/2009 | Weaver | 482/125 |
| 2005/0003931 | A1 * | 1/2005 | Mills et al. | 482/5 |
| 2005/0059537 | A1 * | 3/2005 | Hull | 482/124 |
| 2005/0282689 | A1 * | 12/2005 | Weinstein | 482/124 |
| 2006/0030463 | A1 * | 2/2006 | Maloy et al. | 482/126 |
| 2006/0040805 | A1 * | 2/2006 | Wilkinson | 482/124 |
| 2007/0015642 | A1 * | 1/2007 | Demeniuk | 482/124 |
| 2007/0110950 | A1 * | 5/2007 | Yang | 428/95 |
| 2007/0238591 | A1 * | 10/2007 | Makofsky | 482/126 |
| 2008/0139369 | A1 * | 6/2008 | Vigilia | 482/124 |
| 2009/0062087 | A1 * | 3/2009 | Poppinga | 482/124 |
| 2009/0062088 | A1 | 3/2009 | Ismail et al. | |
| 2009/0118107 | A1 * | 5/2009 | Prstojevich et al. | 482/124 |
| 2009/0312163 | A1 * | 12/2009 | Hern | 482/124 |
| 2009/0315379 | A1 * | 12/2009 | Jacobs et al. | 297/344.18 |
| 2010/0041527 | A1 * | 2/2010 | Miller | 482/124 |

FOREIGN PATENT DOCUMENTS

| | | | |
|---|---|---|---|
| EP | 0352696 | A2 | 1/1990 |
| WO | 9831428 | A3 | 7/1998 |

* cited by examiner

*Primary Examiner* — Allana Lewin

(74) *Attorney, Agent, or Firm* — Galgano & Associates, PLLC; Thomas M. Galgano; Jessica G. Bower

(57) ABSTRACT

A portable exercise apparatus comprising a member, for placing on the user's back, a shoulder strap, extending out of the member, for passing around the user's shoulder, a torso strap, extending out of the member, for passing around the user's torso, wherein the torso strap has a first strap portion and a second strap portion, a resistance band, a latching member, having a first latch portion and a second latch portion, wherein the latch portions are interlockable and the first latch portion is provided on the first strap portion and the second latch portion is provided on the second strap portion, and a locking member, for securing the latch portions in an interlocked position.

12 Claims, 11 Drawing Sheets

PORTABLE EXERCISE APPARATUS

FIELD OF THE INVENTION

This invention relates to a portable exercise apparatus. More specifically, but not exclusively, the invention relates to a portable exercise apparatus for resistance training.

SUMMARY OF THE INVENTION

According to a first aspect of the invention there is provided a portable exercise apparatus comprising a member, for placing on the user's back, a shoulder strap, extending out of the member, for passing around the user's shoulder, a torso strap, extending out of the member, for passing around the user's torso, wherein the torso strap has a first strap portion and a second strap portion, a resistance band, a latching member, having a first latch portion and a second latch portion, wherein the latch portions are interlockable and the first latch portion is provided on the first strap portion and the second latch portion is provided on the second strap portion, and a locking member, for securing the latch portions in an interlocked position.

Optionally, the locking member includes a pin, and the first and second latch portions each have a side defining a hole, for the pin to pass through, such that the holes are in registry when the latch portions are in the interlocked position.

The pin may be attached to the first latch portion by a cord.

Preferably, the member is a chest plate.

The chest plate may include a pair of spaced apart peripheral walls and at least one rib spaced therebetween.

Preferably, the chest plate is injection moulded ABS.

Optionally, the apparatus further includes a chest pad.

Preferably, the chest pad is die cut low-density polythene foam.

Optionally, the resistance band includes a hand grip.

Preferably, the latching locking member is made from ABS.

Preferably, the shoulder straps are made from nylon webbing.

Optionally, the apparatus further includes a case.

Optionally, the case envelops the chest plate and chest pad.

BRIEF DESCRIPTION OF THE DRAWINGS

Other aspects and features of the present invention will become apparent to those ordinarily skilled in the art upon review of the following description of specific embodiments of the invention in conjunction with the accompanying figures.

DETAILED DESCRIPTION OF PREFERRED EMBODIMENTS

Figure 1:
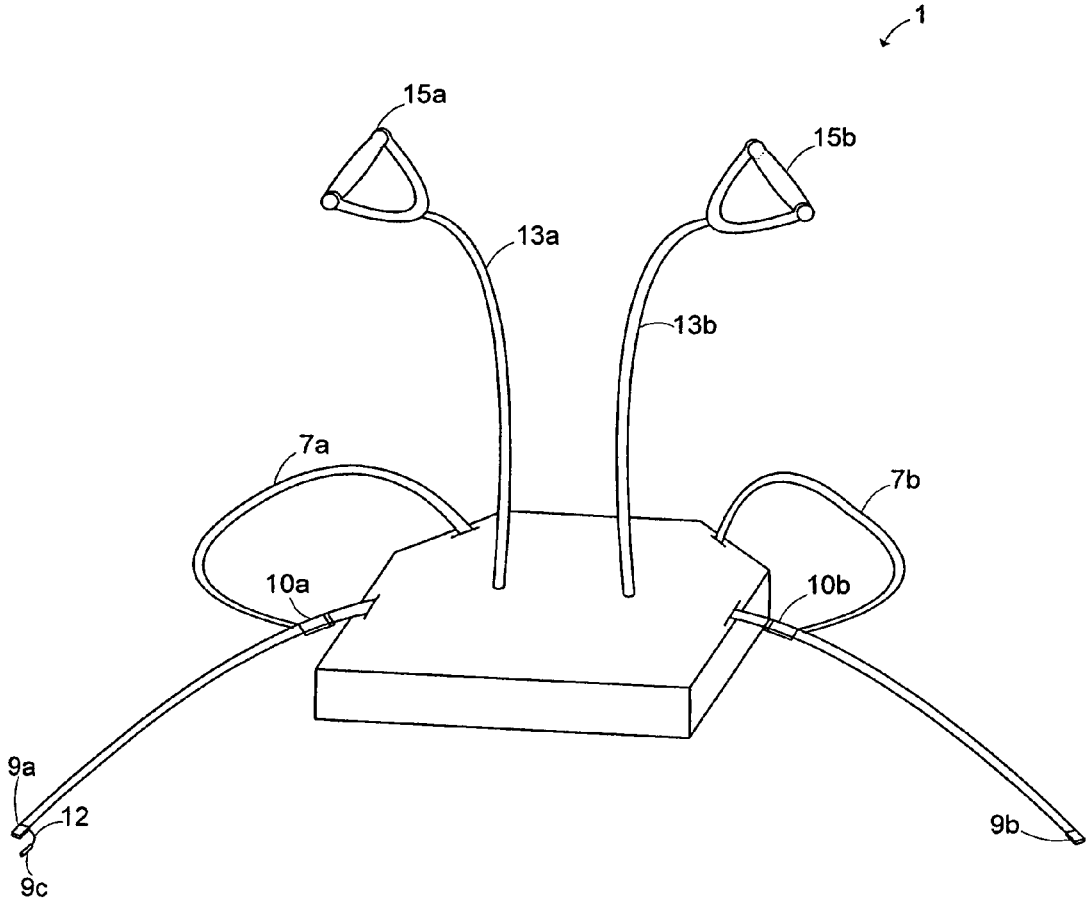
FIG. 1 illustrates a perspective view of an embodiment of a portable exercise apparatus of the present invention.
Figure 2:
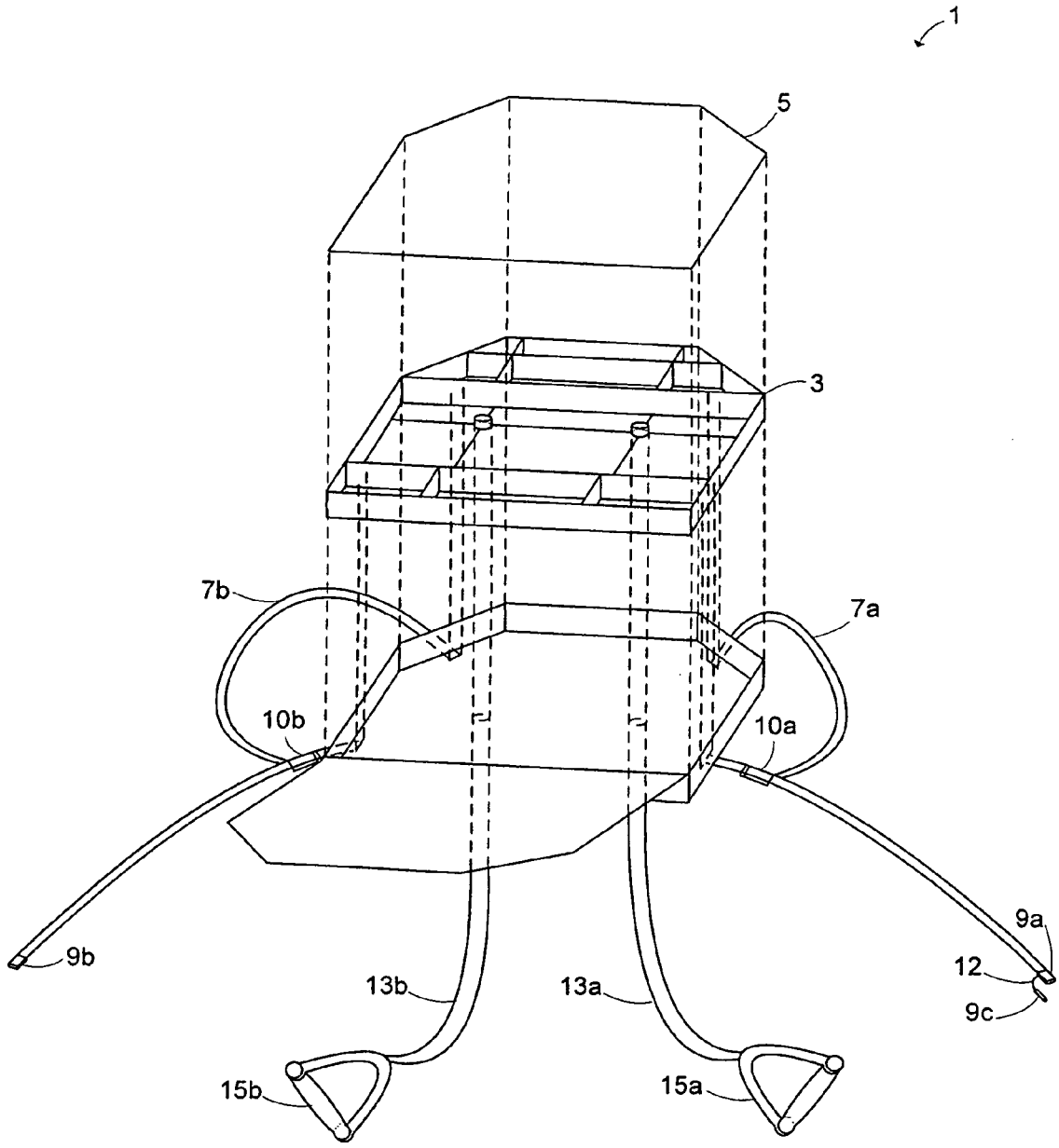
FIG. 2 illustrates a perspective exploded view of the embodiment of the portable exercise apparatus of FIG. 1.
Figure 3:
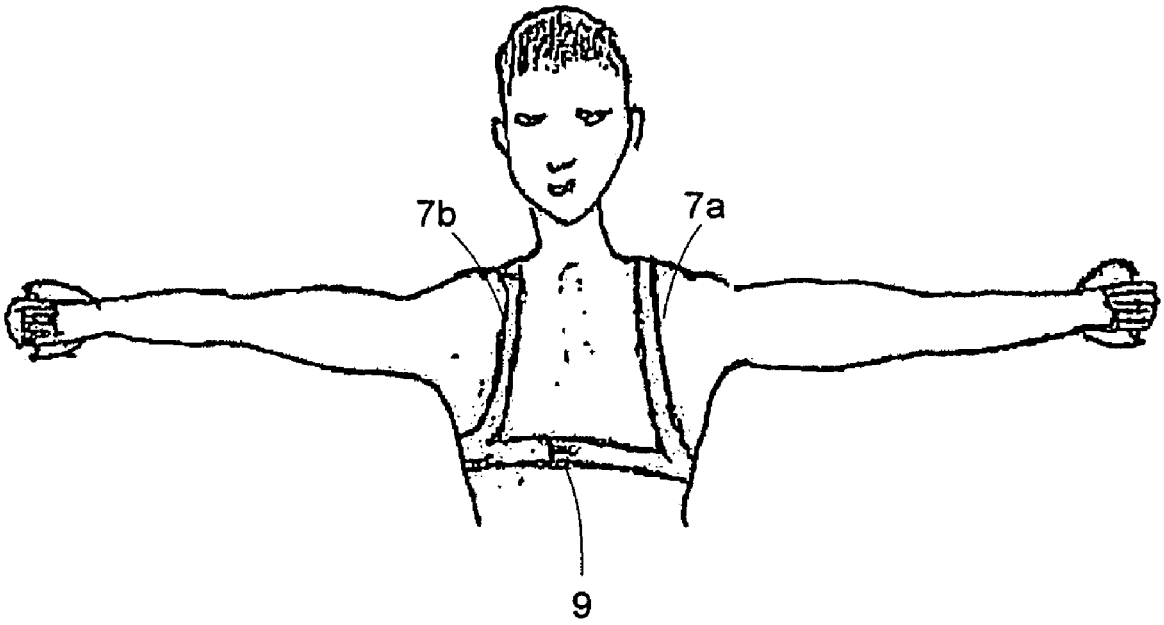
FIG. 3 illustrates a front view of a user wearing the embodiment of the portable exercise apparatus of FIG. 1, extending the resistance band laterally.
Figure 4:
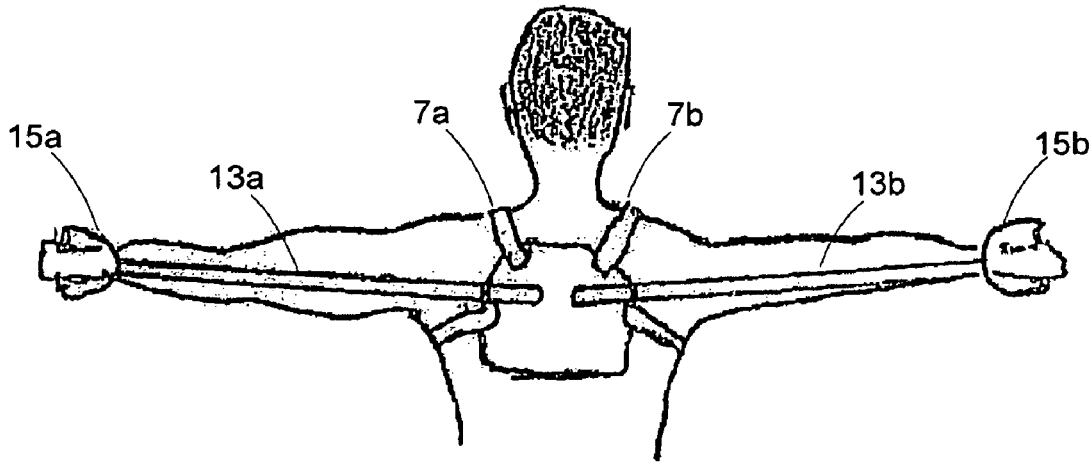
FIG. 4 illustrates a rear view of the user wearing the embodiment of the portable exercise apparatus of FIG. 1, extending the resistance band laterally.
Figure 5:
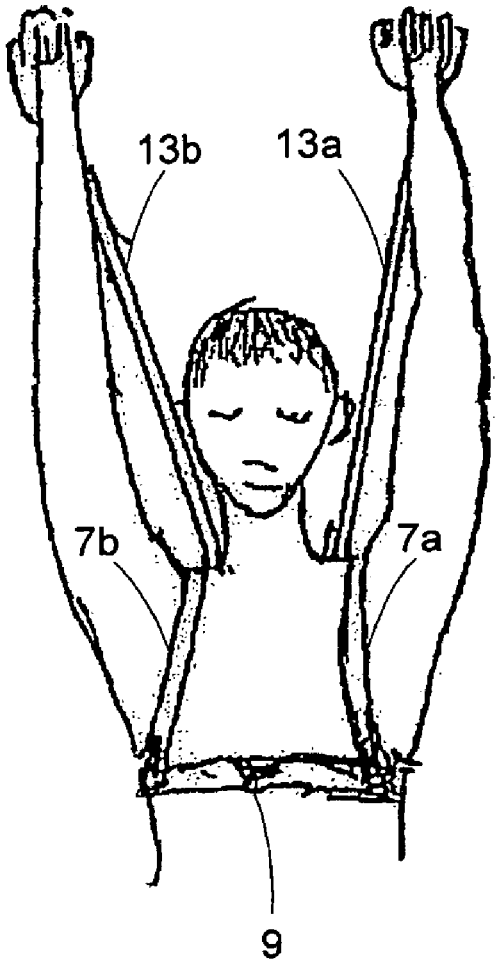
FIG. 5 illustrates a front view of the user wearing the embodiment of the portable exercise apparatus of FIG. 1, extending the resistance band longitudinally.
Figure 6:
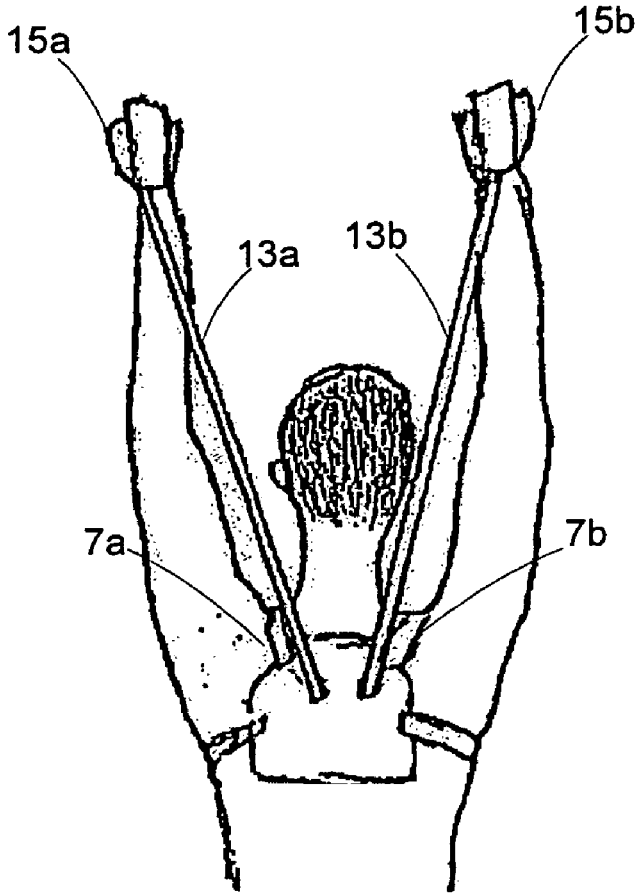
FIG. 6 illustrates a rear view of the user wearing the embodiment of the portable exercise apparatus of FIG. 1, extending the resistance band longitudinally.
Figure 7:
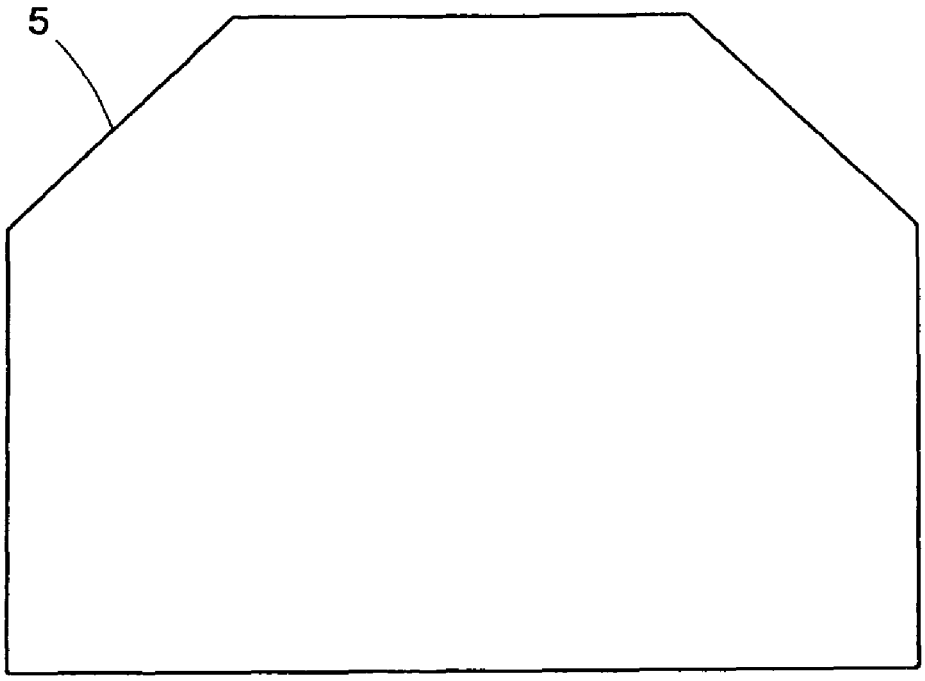
FIG. 7 illustrates a top view of a chest pad of the embodiment of the portable exercise apparatus of FIG. 1.
Figure 8:
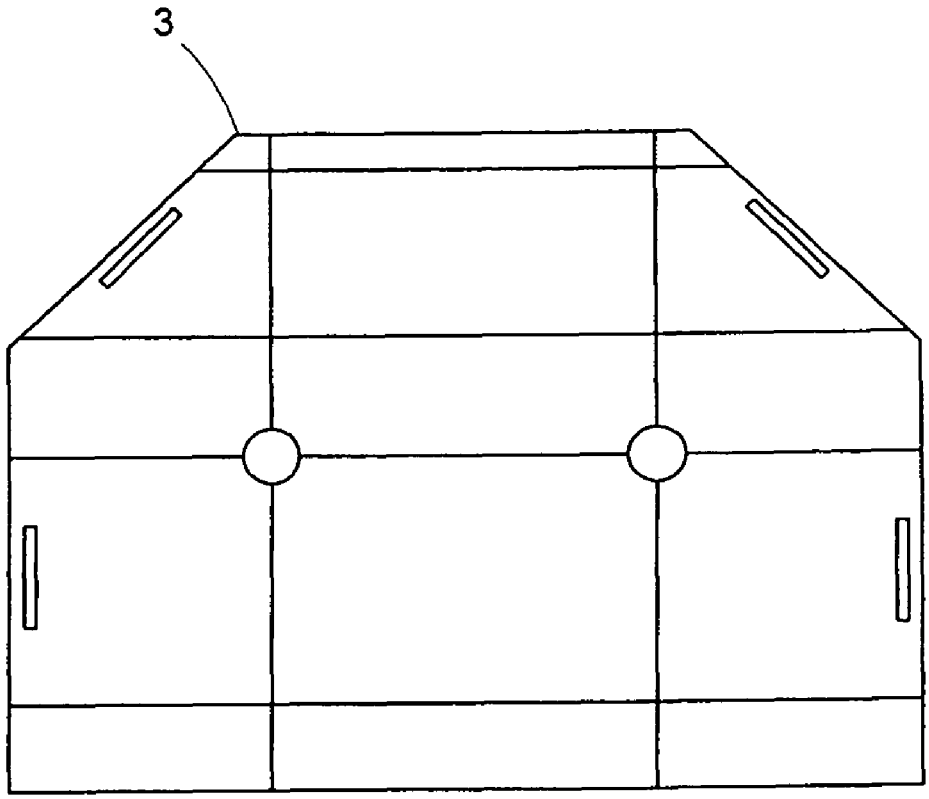
FIG. 8 illustrates a top view of a chest plate of the member of the embodiment of the portable exercise apparatus of FIG. 1.
Figure 9:
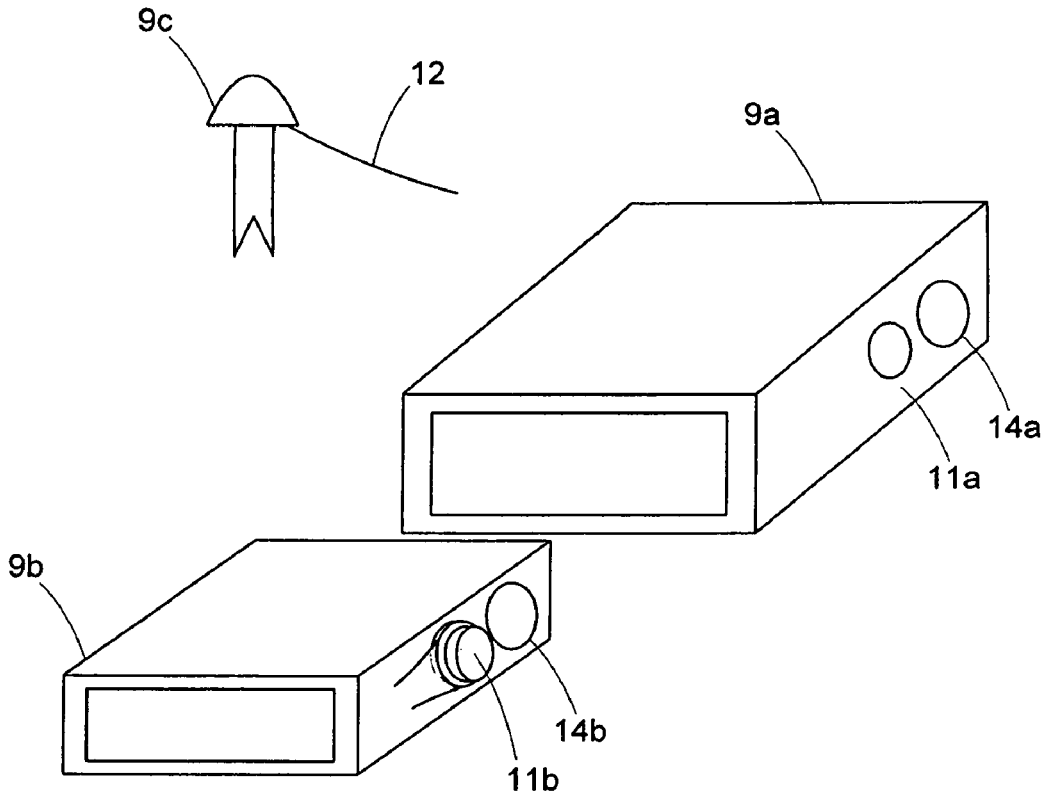
FIG. 9 illustrates a latching member and a locking member of the embodiment of the portable exercise apparatus of FIG. 1.
Figure 10:
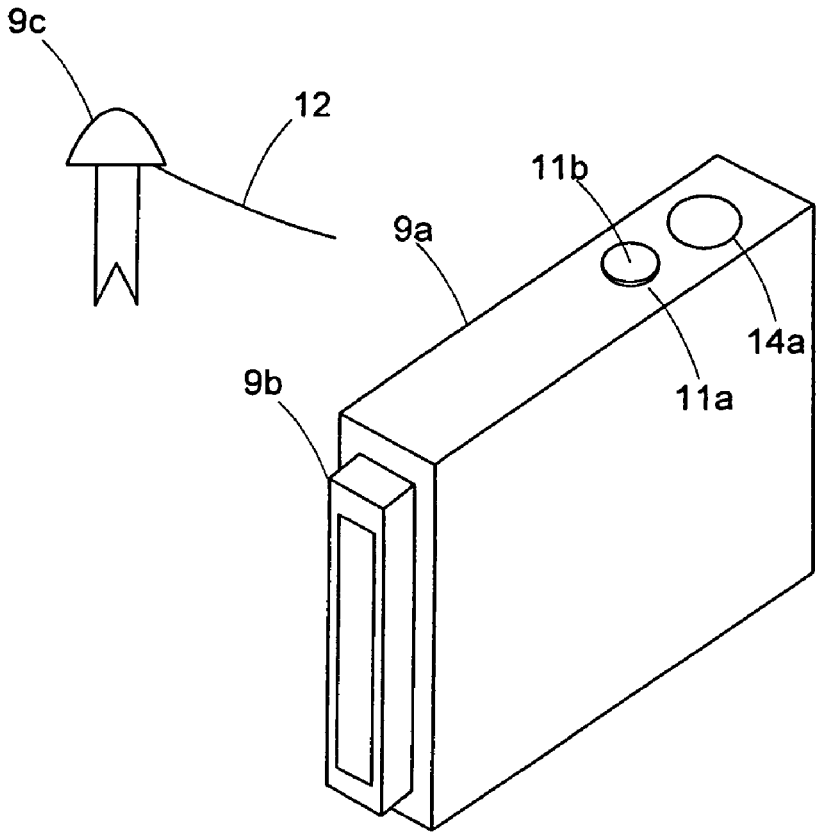
FIG. 10 illustrates a latching member and a locking member of the embodiment of the portable exercise apparatus of FIG. 1, the latching member interlocked.
Figure 11:
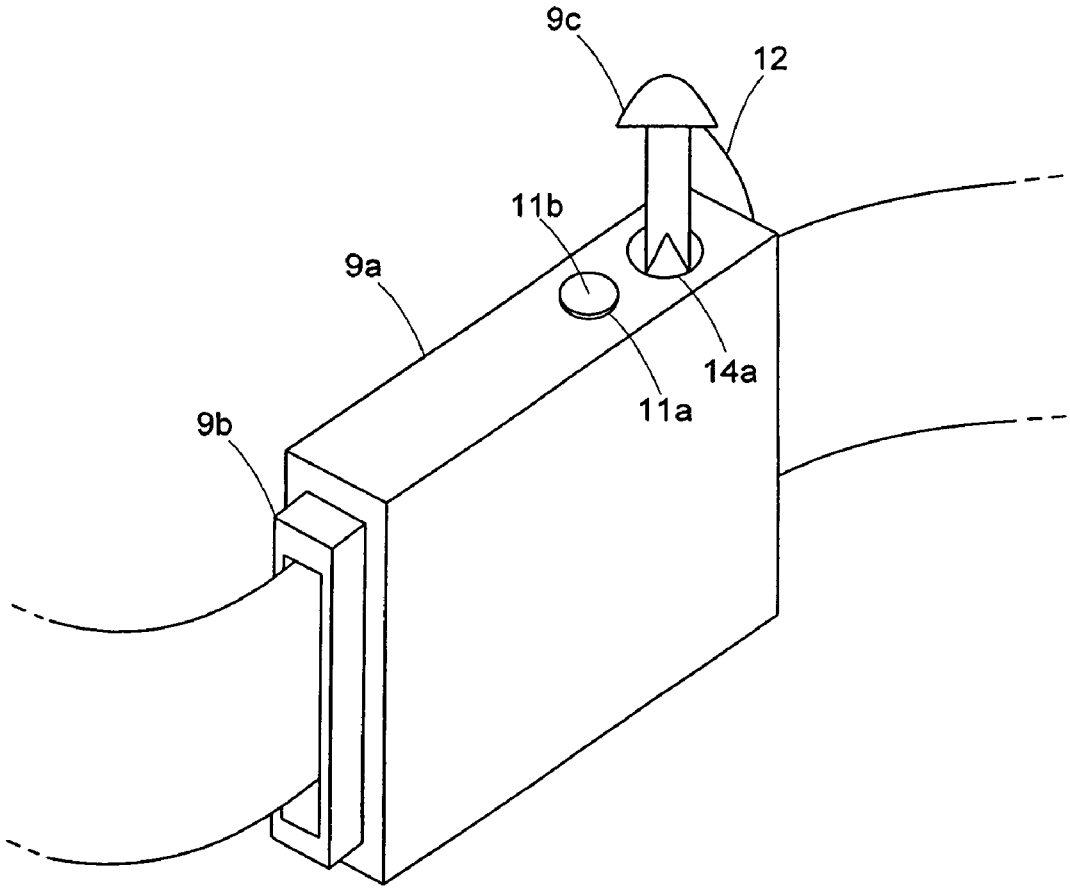
FIG. 11 illustrates a latching member and a locking member of the embodiment of the portable exercise apparatus of FIG. 1, the latching member interlocked and the locking member securing the latching member in the interlocked position.

A K Pac 1 is a compact, portable exercising device targeting the upper torso.

What can A K Pac 1 do?

This invention can enhance fitness and resistance training to the upper body.

What is A K Pac 1?

It is a cost effective and easily manufactured exercising apparatus.

What does A K Pac 1 consist of?

A K Pac 1 comprises an injection moulded ABS chest plate 3 that carries all the other components that make up A K Pac 1.

A die cut low-density polythene foam chest pad 5, cut and sewn nylon web shoulder straps 7*a*, 7*b* and chest buckle 10*a*, 10*b* which incorporates a an OEM buckle made from ABS material.

What do A K Pac shoulder straps 7*a*, 7*b* do?

These straps 7*a*, 7*b* can be adjusted to retain the apparatus on the user's body and hold it in place whilst the apparatus is in use. They are manufactured from a nylon webbing material.

What does A K Pac 1 buckle 10*a*, 10*b* do?

These buckles 10*a*, 10*b* adjust the strap 7*a*, 7*b* by the user for comfort whilst the apparatus is in use on the user's body.

Whilst exercising with A K Pac 1 what holds this device in place?

The box lock mechanism 9*a*, 9*b*, 9*c* will help secure A K Pac 1 to the user's body whilst exercising, incorporated with the adjustable shoulder straps 7*a*, 7*b*.

What is the box lock on A K Pac 1?

This device has a three way locking mechanism device when secured.

Can you please explain?

There are three main components to the box lock.

To wear the A K Pac 1 exercising device place one arm through the should strap 7*a* ensuring that the apparatus is on the back of the user's body, insert the other arm into the other strap 7*b*.

Adjust the buckles 10*a*, 10*b* for comfort of use.

The box lock is in two halves 9*a*, 9*b* that incorporates a safety mechanism 9*c*, in order to secure the box lock together hold one half 9*a* in left hand the other half 9*b* in right hand and insert the smaller of the box 9*b* into the bigger block 9*a*. A slight clicking noise will be heard as the lugs 11*b* are seated in the openings 11*a* that is provided.

Once this is done that is the second phase of the box lock completed.

The third part of this sequence is the safety mechanism 9*c* which is attached to the bigger 9*a* of the box.

Holding this mechanism 9*c* in one of your hands insert the pointed end into the smaller opening 14*a*, 14*b* and firmly push down until it stops.

The other hand will hold the bigger box 9*a* in place whilst pushing the safety mechanism 9*c* firmly into place until it stops.

This is how A K Pac 1 box lock is used

A K Pac 1 Resistance Bands 13*a*, 13*b:*

They can be adapted in a colour coded sequence to suit the user's varying ability during exercise.

A K Pac 1 Hand Grips 15*a*, 15*b:*

These are used in conjunction with the resistance bands 13*a*, 13*b* during the user's exercise programme.

How is A K Pac 1 removed?

After finishing an exercise programme using the A K Pac 1 apparatus:

Hold the bigger box lock 9*a* with one hand and pull the safety mechanism 9*c* from the recess until it has cleared the box lock, which is attached by an umbilical 12 to the bigger box 9*a*.

Using your other hand hold your thumb and forefinger to squeeze the lugs 11*b* at the top and bottom inwardly.

Gently pull apart in opposite directions in a horizontal position to release.

Take arms out of the straps 7*a*, 7*b*.

Gently wipe apparatus with soft cloth, and store away to your individual requirement.

A K Pac 1 will enable the user to achieve agility and fitness whilst working out at their own pace.

With the A K Pac 1 invention, I firmly believe there are no boundaries that cannot be achieved using this exercise apparatus; and fitness levels achieved to any individual.

The invention claimed is:

1. A portable exercise apparatus, comprising:

a member, for placing on the user's back;

a shoulder strap, extending out of said member, for passing around the user's shoulder;

a torso strap, extending out of said member, for passing around the user's torso, wherein said torso strap has a first strap portion and a second strap portion;

a resistance band;

a latching member, having a first latch portion and a second latch portion, wherein said first latch portion is provided on said first strap portion and said second latch portion is provided on said second strap portion, and wherein said latch portions are interlockable in an interlocked position and said first latch portion defines a hollow cavity such that said second latch portion is insertable into said first latch portion in a first direction, and said first and second latch portions each have a side defining a hole such that said holes are in alignment when said latch portions are in said interlocked position; and a locking member, including a pin insertable through said holes of said first and second latch portions for securing said latch portions in said interlocked position by preventing relative movement of said latch portions in said first direction.

2. The portable exercise apparatus as claimed in claim 1, wherein said pin is attached to said first latch portion by a cord.

3. The portable exercise apparatus as claimed in claim 1, wherein said member is a chest plate.

4. The portable exercise apparatus as claimed in claim 3, wherein said chest plate includes a pair of spaced apart peripheral walls and at least one rib spaced therebetween.

5. The portable exercise apparatus as claimed in claim 3, wherein said chest plate is injection molded ABS.

6. The portable exercise apparatus as claimed in claim 3, further comprising a chest pad.

7. The portable exercise apparatus as claimed in claim 6, wherein said chest pad is die cut low-density polythene foam.

8. The portable exercise apparatus as claimed in claim 1, wherein said resistance band includes a hand grip.

9. The portable exercise apparatus as claimed in claim 1, wherein:

said latching member is made from ABS.

10. The portable exercise apparatus as claimed in claim 1, wherein said shoulder strap is made from nylon webbing.

11. The portable exercise apparatus as claimed in claim 6, further comprising a case.

12. The portable exercise apparatus as claimed in claim 11, wherein said case envelops said chest plate and chest pad.

* * * * *